US011852108B1

(12) United States Patent
Nix et al.

(10) Patent No.: US 11,852,108 B1
(45) Date of Patent: Dec. 26, 2023

(54) EXHAUST PURGE GAS FOR COMPRESSOR PACKING SYSTEMS AND METHODS

(71) Applicant: INNIO Waukesha Gas Engines Inc., Waukesha, WI (US)

(72) Inventors: Lorne Eugene Nix, Waukesha, WI (US); Nikolaus Spyra, Innsbruck (AT)

(73) Assignee: Innio Waukesha Gas Engines Inc., Waukesha, WI (US)

( * ) Notice: Subject to any disclaimer, the term of this patent is extended or adjusted under 35 U.S.C. 154(b) by 0 days.

(21) Appl. No.: 18/162,548

(22) Filed: Jan. 31, 2023

(51) Int. Cl.

| | |
|---|---|
| ***F02M 26/34*** | (2016.01) |
| ***F02M 26/09*** | (2016.01) |
| ***F02M 26/05*** | (2016.01) |
| ***F02D 41/14*** | (2006.01) |
| ***F02D 41/00*** | (2006.01) |

(52) U.S. Cl.
CPC ..... *F02M 26/09* (2016.02); *F02D 41/0077* (2013.01); *F02D 41/1454* (2013.01); *F02M 26/05* (2016.02); *F02M 26/34* (2016.02)

(58) Field of Classification Search
CPC ..... F02M 26/34; F02M 26/09; F04B 39/042; F16J 15/56
See application file for complete search history.

(56) References Cited

U.S. PATENT DOCUMENTS

| | | | | |
|---|---|---|---|---|
| 2,991,003 | A * | 7/1961 | Petersen | F04B 39/042 417/267 |
| 2011/0094486 | A1* | 4/2011 | Vuk | F01N 5/04 123/568.21 |
| 2022/0106919 | A1* | 4/2022 | Carlén Andersson | F02M 26/09 |
| 2023/0054060 | A1* | 2/2023 | Dou | B60K 6/485 |

FOREIGN PATENT DOCUMENTS

| | | | | |
|---|---|---|---|---|
| CA | 2987650 | A1 * | 6/2018 | F04B 39/041 |
| DE | 102016218809 | A1 * | 3/2018 | F01D 15/10 |
| EP | 3786495 | A1 * | 3/2021 | F16J 15/004 |
| EP | 3812582 | A1 * | 4/2021 | F04B 35/01 |
| JP | 3998861 | B2 * | 10/2007 | F02D 21/08 |
| WO | WO-2011035967 | A1 * | 3/2011 | F01N 5/02 |

* cited by examiner

*Primary Examiner* — Ngoc T Nguyen
(74) *Attorney, Agent, or Firm* — Fletcher Yoder P.C.

(57) ABSTRACT

A gas compression system may include a gas compressor having a compressor rod, a piston, and an interior chamber. The gas compressor may receive a process gas at a first pressure, pressurize the process gas via the piston, and output the process gas at a second pressure higher than the first. Additionally, an internal combustion engine coupled to the gas compressor may, during operation, actuate the compressor rod and generate exhaust gas. The gas compression system may also include a packing case, disposed around the compressor rod and fluidly coupled to the interior chamber. The packing case may receive and direct the exhaust gas to counter a flow of the process gas through the packing case from the interior chamber.

20 Claims, 4 Drawing Sheets

EXHAUST PURGE GAS FOR COMPRESSOR PACKING SYSTEMS AND METHODS

BACKGROUND

The subject matter disclosed herein relates to engines and gas compressors. More specifically, the techniques discussed herein relate to using exhaust gas from an engine as a purge gas in a packing case of the gas compressor.

An engine may include pistons disposed in respective cylinders of an engine block or a turbine section to convert the expanding gases of a combustion process into mechanical energy. In some scenarios, the engine is used to drive a gas compression system that receives a gaseous fluid from an upstream source, increase the pressure of the gaseous fluid, and supply the gaseous fluid at the increased pressure to one or more downstream systems. Moreover, the gas compression system may utilize one or more pistons driven by associated compressor rods that compress the gaseous fluid. However, at the interface of the compressor, due to the actuation of the compressor rod(s) and/or the increased pressure of the gaseous fluid, some gaseous fluid may be expelled from the compressor system.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In certain embodiments, a gas compression system may include a gas compressor having a compressor rod, a piston, and an interior chamber. The gas compressor may receive a process gas at a first pressure, pressurize the process gas via the piston, and output the process gas at a second pressure higher than the first. Additionally, an internal combustion engine coupled to the gas compressor may, during operation, actuate the compressor rod and generate exhaust gas. The gas compression system may also include a packing case, disposed around the compressor rod and fluidly coupled to the interior chamber. The packing case may receive and direct the exhaust gas to counter a flow of the process gas through the packing case from the interior chamber.

In certain embodiments, a method may include actuating a compressor rod of a gas compressor such that a process gas is pressurized within a chamber of the gas compressor. The compressor rod may extend from the chamber and through a packing case coupled to the gas compressor. The method may also include generating, via an internal combustion engine, exhaust gas, and supplying the exhaust gas to the packing case such that the exhaust gas permeates through the packing case, around the compressor rod, and into the chamber, out a vent passage of the packing case, or both.

In certain embodiments, a gas compressor may include a housing having an interior chamber, an intake to the interior chamber, an outlet from the interior chamber, and a compressor rod orifice. The gas compressor may also include a piston that actuates within the interior chamber and operatively motivates a first flow of a process gas from the intake to the outlet. Furthermore, a compressor rod mechanically coupled to the piston within the interior chamber may extend out of the interior chamber through the compressor rod orifice and, upon actuation, actuate the piston. Additionally, the gas compressor may include a packing case coupled to and sealed against the housing. The compressor rod may extend through an interior of the packing case, and the packing case may receive and direct a purge gas (e.g., exhaust gas from an internal combustion engine) into the interior of the packing case at a first pressure higher than a second pressure within the interior chamber of the housing to reduce a second flow of the process gas from the interior chamber through the interior of the packing case.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
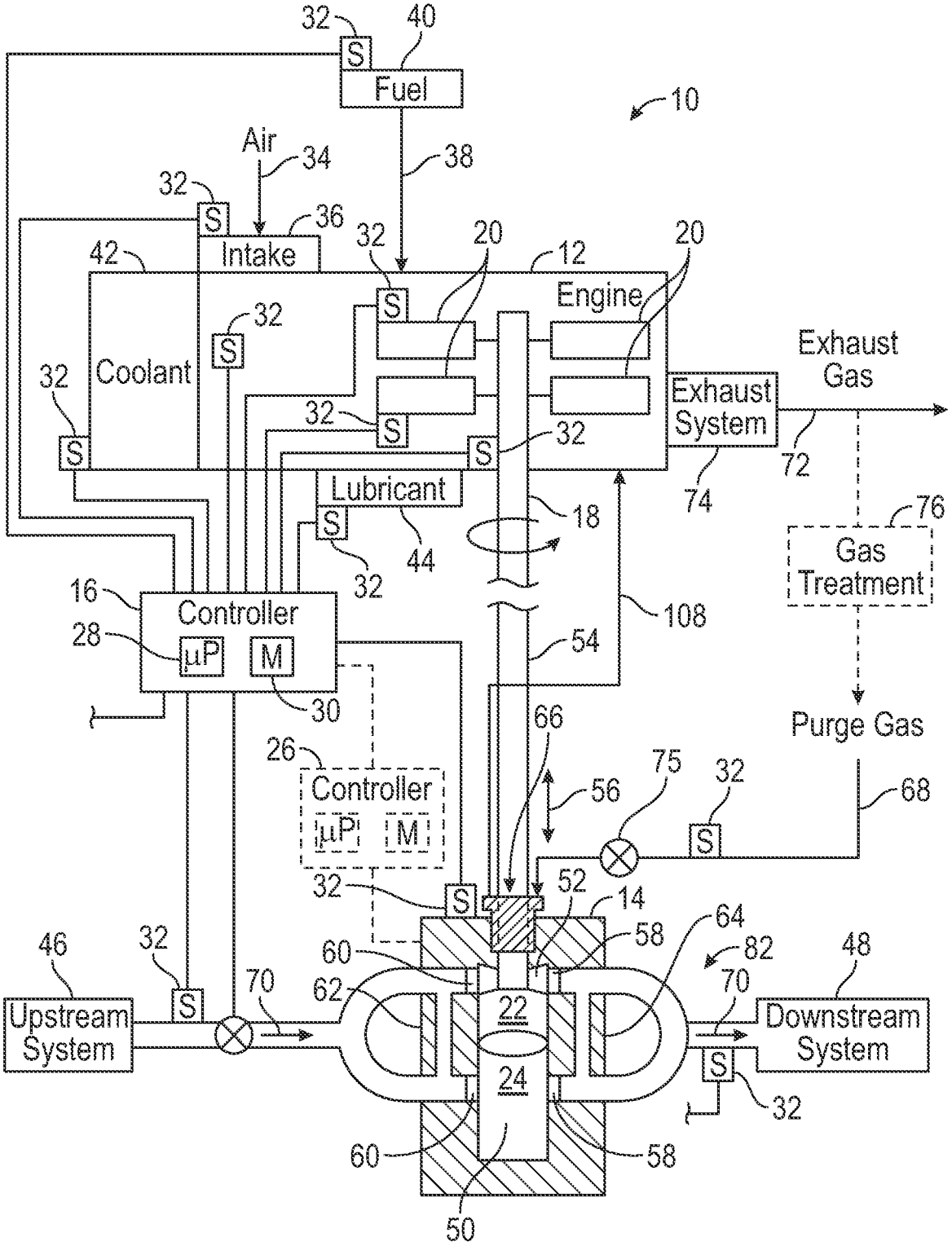
FIG. 1 is a schematic block diagram of an embodiment of a gas compression system with an engine, a gas compressor, and a controller, in accordance with an embodiment.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As discussed in detail below, the techniques discussed herein relate to using exhaust gas from an engine as a purge gas in a packing case of a gas compressor system. In general, gas compression systems may receive a gaseous fluid from an upstream source, increase the pressure of the gaseous fluid, and supply the gaseous fluid at the increased pressure to one or more downstream systems. Furthermore, the gas compression systems may utilize engines to drive a gas compressor, such as a reciprocating compressor. For example, an engine may turn a crankshaft that is coupled to a compressor rod that linearly actuates a piston of the gas compressor to pressurize the gaseous fluid such as natural gas or other gaseous mixture. Moreover, the gas compressor may include a packing case extending through a sidewall of the compression chamber to seal around the compressor rod as it actuates the piston. However, due to the actuation of the compressor rod and/or the pressurization of the gaseous fluid in the compression chamber, a portion of the gaseous fluid may flow through the packing case and into other components of the gas compression system (e.g., distance piece(s) between the engine and the gas compressor, a crankcase, etc.) and/or the environment. Depending on the composition of the gaseous fluid such leakage may not be desirable. For example, loss of desirable gaseous fluids (e.g., natural gas or other hydrocarbons) via leakage may reduce the efficiency and/or efficacy of the gas compression system. Furthermore, the primary process gas (e.g., natural gas, other hydrocarbon, or other gaseous substance) and/or additional components that may be present within the gaseous fluid (e.g., hydrogen sulfide, etc.) may have adverse effects on components of the gas compression system and/or the environment, if leaked from the packing case.

To reduce or eliminate leakage through the packing case, a purge gas may be used to pressurize the packing case from the exterior of the compressor, balancing or overcoming the pressure of the gaseous fluid at the distal end (e.g., away from the compression chamber) of the packing case, which may have leaked through the packing case from the compression chamber. As such, the purge gas may be forced into the packing case either to a vent passage and/or to the compression chamber. In some embodiments, the purge gas may have a pressure greater than or equal to (e.g., 5 pounds per square inch (psi) greater than, 5-15 psi greater than, 15 or more psi greater than) that of the vent passage of the packing case, which may controllably expel the purge gas, the gaseous fluid that has leaked into the packing case, and/or a mixture thereof. Furthermore, as the packing case may perform some amount of sealing around the compressor rod, the pressure at the distal end of the packing case may be less than that of the compression chamber. As such, the purge gas pressure may depend on implementation based on the pressure of the gaseous fluid that would otherwise leak from the distal end of the packing case. As should be appreciated, the pressure within the compression chamber may be time varying according to the operation of the compressor. As such, the pressures discussed herein may be indicative of maximum or time averaged pressures. As should be appreciated, the pressures and relative pressures given herein are given as examples and are, as such, non-limiting.

As discussed above, some or all of the purge gas may mix the with gaseous fluid before being expelled via a vent passage of the packing case or forced into the flow path of the gaseous fluid and continue to the downstream system(s). However, depending on the composition of the gaseous fluid, it may be desirable to utilize an inert or otherwise low oxygen content (e.g., less than 5%, less than 3%, less than 1%, or less than 0.5% by weight or by volume) gas. For example, carbon dioxide, nitrogen, or other inert gas may be used as a purge gas. Additionally or alternatively, the purge gas may be or include natural gas that may have been treated (e.g., sweet natural gas), for example, to reduce or eliminate hydrogen sulfide content. However, some gas compression systems are located in remote areas, thereby increasing the time and cost associated with maintenance of components of the gas compression systems and/or refilling of such purge gases. As such, a more readily available and renewable purge gas such as the exhaust of a nearby engine (e.g., the engine driving the compressor system) may be used to increase maintenance efficiency and the efficacy of remote gas compression systems.

Engine exhaust is a byproduct of the internal combustion process that generates the mechanical energy to drive the gas compressor or other system. As such, due to the oxidation reaction of combustion, the oxygen content of engine exhaust is relatively low compared to that of ambient air. Furthermore, in some embodiments, the engine may be run using a stoichiometric balance of intake air and fuel to reduce the unburned fuel and/or oxygen content of the exhaust further. The exhaust may be treated via one or more filters, air scavengers, boost pumps, etc. to ready the exhaust to be used as a purge gas depending on implementation.

With the foregoing in mind, FIG. 1 is a schematic block diagram of an embodiment of a gas compression system 10 with an engine 12, a gas compressor 14, and a controller 16. The engine 12 may be coupled to and drive the gas compressor 14 by a crankshaft 18. The engine 12 may be an internal combustion engine that includes, but is not limited to a reciprocating internal combustion engine having one or more piston-cylinder assemblies 20, each having a piston that actuates within a cylinder. In some embodiments, the engine 12 is a turbine engine or a rotary engine. The gas compressor 14 may be a reciprocating compressor with one or more pistons 22. The gas compressor 14 shown in FIG. 1 has one piston 22 shown for clarity, and it may be appreciated that the gas compressor 14 may include 2, 3, 4, 5, 6, 7, 8, 9, 10, or more pistons. Moreover, each piston 22 of a reciprocating gas compressor may be a double-acting piston, thereby enabling the piston 22 to compress a gas on both sides of the piston 22 as it reciprocates within its chamber 24.

The controller 16 of the gas compression system 10 may be coupled to the engine 12 and the gas compressor 14. Although FIG. 1 illustrates a common controller 16 coupled to both the engine 12 and the gas compressor 14, some embodiments of the gas compression system 10 may have the controller 16 (e.g., engine control unit (ECU)) coupled to the engine 12 to monitor and control the engine 12, and a second controller 26 (e.g., compressor control unit) coupled to the gas compressor 14 to monitor and control the gas compressor 14. The controller 16 (and the second controller 26, if present) may include a processor 28 and a memory 30. The memory 30 includes non-transitory, tangible, computer-readable medium storing instructions that are configured to cause the processor to perform specific actions, such as the methods discussed herein. The controller 16 may be coupled to one or more sensors 32 throughout the gas compression control system. Additionally, the controller 16 may be coupled to controls or valves of the engine 12 to control operation of the engine 12. For example, the controller 16 may control a throttle of the engine 12, the flow rates of air and fuel into the engine 12, and the direction of fluids (e.g., coolant, lubricant) through the engine 12. In some embodiments, the controller (e.g., controller 16, ECU, compressor control unit 26) may determine a desired engine speed (e.g., revolutions per minute (RPM)) of the engine 12, and control the engine 12 to operate at the desired engine speed. For example, the compressor control unit 26 may determine an engine RPM setpoint, provide the engine RPM setpoint to the ECU coupled to the engine 12, and the ECU may control the engine 12 to operate at the engine RPM setpoint. The controller 16 may be coupled to controls or valves of the gas compressor 14 to control operation of the gas compressor 14.

The engine 12 may receive air 34 through an intake manifold 36 for mixing with fuel 38 from a fuel source 40 for combustion within the one or more piston-cylinder assemblies 20. That is, the air 34 received through the intake manifold 36 may be directed through the engine 12 to be combusted with the fuel 38 in the engine 12. The fuel 38 may include a liquid fuel (e.g., diesel, gasoline) or a gaseous fuel (e.g., methane (natural gas), propane, etc.). In some embodiments, the controller 16 may adjust the flow rates of the air 34 and fuel 38 to maintain a particular air-to-fuel ratio, which may vary based on implementation. For example, the air-to-fuel ratio may be stoichiometrically balanced, lean, or rich. A coolant system 42 (e.g., radiator) coupled to the engine 12 may facilitate temperature control (e.g., cooling) of the engine 12 during operation by directing a coolant through the engine 12. In some embodiments, the coolant system 42 may be coupled to the gas compressor 14 to facilitate temperature control of the gas compressor 14 during operation by directing a coolant through the gas compressor 14. A lubricant system 44 coupled to the engine 12 may direct a lubricant (e.g., oil) to moving components of the engine 12. In some embodiments, the sensors 32 of the gas compression system 10 may include, but are not limited to gas composition sensors (e.g., oxidant sensors, lambda sensors), flow sensors, temperature sensors (e.g., coolant temperature sensors, lubricant temperature sensors, intake manifold temperature sensors, compressor discharge temperature sensors), vibration sensors, knock detection sensors, compressor rod load sensors, pressure sensors (e.g., intake manifold pressure sensors), speed sensors (e.g., tachometers), microphones, or any combination thereof. In some embodiments, the controller 16 may utilize feedback from the sensors 32 of the gas compression system 10 to calculate gas compression system parameters (e.g., engine load, compressor rod load). For example, the compressor rod load may be determined based on a speed of the engine, measured pressures from the gas compressor, and known properties (e.g., mass, geometry) of components of the gas compressor.

The gas compressor 14 receives a gas from an upstream system 46, pressurizes the gas with the piston 22 in the chamber 24, and discharges the pressurized gas to a downstream system 48. As discussed above, the one or more pistons 22 of the gas compressor 14 may be double-acting pistons, thereby forming two sections 50, 52 of the chamber 24. The crankshaft 18 may drive one or more compressor rods 54 of the gas compressor 14. The gas compressor 14 may convert the rotational motion of the crankshaft 18 of the engine 12 to a reciprocating motion 56 of the one or more compressor rods 54, thereby enabling the one or more pistons 22 to reciprocate within the chamber 24. The gas compressor 14 may have a sensor 32 coupled to the one or more compressor rods 54, thereby enabling the controller 16 to determine a compressor rod load from feedback of the respective sensors 32 (e.g., load sensor).

The gas compressor 14 may include a series of valves coupled to the sections 50, 52 of the chamber 24. For example, the portion of the reciprocating gas compressor 14 shown in FIG. 1 includes two discharge valves 58 and two intake valves 60, one of each valve 58, 60 for each section 50, 52 of the chamber 24 with the double-acting piston 22. In other embodiments, the gas compressor 14 may include more than the two discharge valves 58 and more than the two intake valves 60, depending on how many pistons 22 (and, thus, how many corresponding chambers 24) are included in the gas compressor 14. Moreover, the quantity of valves (e.g., discharge valves 58, intake valves 60) for each piston 22 or chamber 24 may be based at least in part on the size of the piston 22 or chamber 24. That is, larger pistons 22 or chambers 24 may have more valves than smaller pistons 22 or chambers 24. As the piston 22 reciprocates away from the second section 52 of the chamber 24, a size (e.g., volume) of the second section 52 increases. The volume increase of the second section 52 of the chamber 24 causes a pressure differential (e.g., vacuum) between the fluid in the second section 52 of the chamber 24 and a suction manifold 62 coupled with the second section 52 at the intake valve 60. As the pressure differential exceeds a threshold pressure associated with the intake valve 60, the intake valve 60 opens, enabling fluid communication between the suction manifold 62 and the second section 52 of the chamber 24. After the intake valve 60 opens, the pressure differential also causes fluid (e.g., gas) to be drawn (e.g., sucked) into the second section 52 of the chamber 24 through the intake valve 60. Accordingly, the second section 52 fills with the fluid.

Further, as the piston 22 moves toward the first section 50 of the chamber 24 in FIG. 1, a volume of the first section 50 decreases. Thus, fluid (e.g., gas) within the first section 50 is compressed as the piston 22 moves toward the first section 50. After the fluid pressure within the first section 50 of the chamber 24 exceeds a threshold pressure of the discharge valve 58 associated with the first section 50, the discharge valve 58 opens. As the discharge valve 58 opens, the discharge valve 58 enables fluid communication between the first section 50 of the chamber 24 and a discharge manifold 64 coupled with the first section 50 at the discharge valve 58. Due to the pressure differential between the fluid in the first section 50 of the chamber 24 and in the discharge manifold 64, the compressed fluid within the first section 50 flows toward and into the discharge manifold 64. The compressed fluid is then delivered to the downstream system 48. The downstream system 48 may include an oil refinery, a gas pipeline, a chemical plant, a natural gas processing system, a refrigeration system, an air separation system, a biogas system, a fertilizer production system, a gas lift system, a hydrotreatment system, a polymer production system, an underground gas storage system, or any other suitable system or process.

As the piston 22 reciprocates away from the first section 50 of the chamber 24, the size (e.g., volume) of the first section 50 increase. The volume increase of the first section 50 of the chamber 24 causes a pressure differential (e.g., vacuum) between the fluid in the first section 50 and the suction manifold 62 coupled with the first section 50 at the intake valve 60. As the pressure differential exceeds the threshold pressure associated with the intake valve 60, the intake valve 60 opens, enabling fluid communication between the suction manifold 62 and the first section 50 of the chamber 24. After the intake valve 60 opens, the pressure differential also causes the fluid (e.g., gas) to be drawn (e.g., sucked into the first section 50 of the chamber 24 through the intake valve 60 of the first section 50. Accordingly, the first section 50 fills with the fluid (e.g., gas).

Further, as the piston 22 reciprocates toward the second section 52 of the chamber 24, the volume of the second section 52 decreases. Thus, fluid (e.g., gas) within the second section 52 is compressed as the piston 22 moves toward the second section 52. After the fluid pressure within the second section 52 exceeds a threshold pressure of the discharge valve 58, the discharge valve 58 opens. As the discharge valve 58 opens, the discharge valve 58 enables fluid communication between the second section 52 of the chamber 24 and the discharge manifold 64 coupled with the second section 52 at the discharge valve 58. Due to the pressure differential between the fluid (e.g., gas) in the second section 52 of the chamber 24 and in the discharge manifold 64, the compressed fluid within the second section 52 flows toward and into the discharge manifold 64. The compressed fluid is then exported elsewhere for other purposes, as described above.

At the interface between the compressor rod 54 and the gas compressor 14, a packing case 66 (e.g., annular packing case) may be used to seal and/or steady the compressor rod 54 during the reciprocating motion 56. As should be appreciated, the packing case 66 may be any suitable interface for coupling the compressor rod 54 through the housing of the gas compressor 14, and may include one or more annular sealing elements, such as seals, packing cups, bearings, sleeves, etc. The annular sealing elements may include metal sealing elements, elastomeric sealing elements, composite sealing elements, or any combination thereof. The annular seal elements also may be spaced axially apart from one another about the compressor rod 54. Unfortunately, due to the actuation (e.g., rotational motion and/or reciprocating motion 56) of the compressor rod 54 and/or the pressurization of the gaseous fluid in the chamber 24, a portion of the gaseous fluid may be motivated to leak through the packing case 66 and into the environment or other portions of the gas compression system 10. To reduce or eliminate leakage through the packing case 66, a purge gas 68 may be used to pressurize the packing case 66 from the exterior of the gas compressor 14, balancing or overcoming the pressure of the gaseous fluid that would otherwise leak from the distal end of the packing case 66. By pressurizing the packing case 66 with purge gas 68, the gaseous fluid (i.e., process gas 70) that would otherwise leak from the packing case 66 may be forced back into/toward the chamber 24 and/or be controllably released via a vent of the packing case 66. In certain embodiments, the purge gas 68 may be supplied between the annular sealing elements of the packing case 66, thereby providing a pressure differential to help inhibit gas leakage of the purge gas 68. For example, the purge gas 68 may create a relatively higher-pressure zone of the purge gas 68 between the annular sealing elements, thereby substantially reducing leakage of the process gas 70 and/or preferentially leaking the purge gas 68 rather than the process gas 70 across the annular sealing elements of the packing case 66.

As the purge gas 68 is used to keep the process gas 70 from leaking out of the packing case 66, some or all of the purge gas 68 may mix the with process gas 70 (e.g., forming a gas mixture 108 discussed further below) before being expelled via a vent passage of the packing case 66 and/or being forced into the chamber 24 and continuing to the downstream system(s) 48. However, depending on the composition of the process gas 70, it may be desirable to utilize an inert or otherwise low oxygen content (e.g., less than 5%, less than 3%, less than 1%, or less than 0.5% by weight or by volume) gas. For example, carbon dioxide, nitrogen, or other inert gas, as well as natural gas that has been treated/processed (e.g., sweet natural gas), for example, to reduce or eliminate hydrogen sulfide content, may be used as a purge gas 68. However, maintaining auxiliary systems (e.g., liquid nitrogen storage tank) and/or restocking such auxiliary systems with purge gas 68 may increase the complexity of the gas compression system 10 as well as increase time and/or cost associated with installing and/or maintaining of the gas compression system 10. As such, a more readily available and renewable purge gas 68 such as the exhaust gas 72 of a nearby engine 12 (e.g., the engine driving the gas compressor 14) may be used to increase installation and maintenance efficiency as well as increase the efficacy of more remote gas compression systems 10. As should be appreciated, while discussed herein as utilizing the exhaust gas 72 of the engine 12 driving the gas compressor 14, the exhaust gas 72 may be from any suitable engine 12 or combustion system providing adequate amounts of exhaust gas 72, which may depend on implementation. For example, the exhaust gas 72 may be retrieved from a furnace, a boiler, or a heating system using combustion of fuel. Moreover, the exhaust gas 72 of a single engine 12 may be utilized for purge gas 68 for multiple packing cases 66 and/or gas compressors 14 or the purge gas 68 for a packing case 66 may be a mixture of exhaust gases 72 from multiple engines 12. Furthermore, as discussed further below, the gas mixture 108 of exhaust gas 72 (e.g., used as purge gas 68) and process gas 70 (e.g., controllably vented via the vent passage) may be relayed to the engine 12 or multiple engines 12, for example, to be consumed as fuel 40 and/or part of an exhaust gas recirculation (EGR) process.

As stated above, the engine 12 may provide the mechanical energy for the reciprocating motion 56 via internal combustion, which may generate exhaust gas 72. In general, such exhaust gas 72 is expelled to the environment and/or reused by engine 12 (e.g., in an exhaust gas recirculation (EGR) process). However, additional utility may be found by recycling a portion of the exhaust gas 72 as purge gas 68. Indeed, as a byproduct of the internal combustion process the exhaust gas 72 may, depending on the operation (e.g., air-to-fuel ratio) of the engine 12, have an oxygen content that is relatively low (e.g., less than 5%, less than 3%, less than 1%, or less than 0.5% by weight or by volume) and be suitable for use as the purge gas 68. Furthermore, in some embodiments, the engine 12 may be run using a stoichiometric balance of intake air and fuel to further reduce the unburned fuel and/or oxygen content (e.g., less than 1% oxygen by weight) of the exhaust gas 72, relative to a lean or rich mixture. As should be appreciated, a perfect stoichiometric balance may be difficult or impractical to achieve in a realistic scenario. As such, as used herein, stoichiometric operation may refer to operation of the engine 12 with lambda values (i.e., air-to-fuel equivalence ratios) between 0.990 and 1.100. Furthermore, lean burn operation may be considered to have lambda values greater than 1.100, and rich burn (e.g., sub-stoichiometric) operation may be considered to have lambda values less than 0.990.

In some scenarios, the exhaust gas 72 of a stoichiometrically balanced combustion process may be suitable for direct use as the purge gas 68 at the packing case 66. As should be appreciated, the desired composition of the purge gas 68 may vary based on the composition of the process gas 70. Furthermore, in some scenarios, it may be more desirable to allow the process gas leakage than introduce purge gas 68 with an undesirable composition (e.g., due to oxygen or chemical compound content). As such, in some embodiments, the controller 16 may utilize one or more sensors 32 to monitor the composition (e.g., oxygen content) and/or pressure of the purge gas 68 and selectively use, not use, or regulate the flow of the purge gas 68 (e.g., via a valve 75) and/or regulate the operation of the engine 12 based thereon. For example, in response to the purge gas 68 having oxygen content greater than a threshold amount, the controller 16 may close the valve 75 stopping the introduction of the purge gas 68 into the packing case 66. Additionally or alternatively, the controller 16 may monitor other parameters (e.g., fuel flow, air flow, fuel-to-air ratio) or operating modes (e.g., stoichiometric or non-stoichiometric) of the engine 12 that may affect the composition of the purge gas 68. Moreover, such other parameters may be controlled (e.g., via the controller 16) based on and/or to effect an oxygen content of the purge gas 68 less than a threshold. Furthermore, depending on implementation (e.g., the type of process gas 70 being pressurized, the oxygen content of the exhaust gas 72, etc.), the exhaust gas 72 may be treated via an exhaust system 74 of the engine and/or via auxiliary treatments 76 (as discussed below in relation to FIG. 2) to prepare the exhaust gas 72 for use as the purge gas 68.

In general, the exhaust system 74 of the engine 12 may treat/process the exhaust gas 72 via one or more gas treatment systems (e.g., catalytic converters), noise reducers (e.g., mufflers/silences), flame arrestors, heat exchangers, etc. prior to being expelled to the environment. Furthermore, in some scenarios, the exhaust system 74 may include a turbine stage of a turbo charger for forced induction of the air 34 into the engine 12. In some embodiments, the portion of the exhaust gas 72 used as the purge gas 68 may be treated in the same way as exhaust gas 72 that is to be expelled to the environment. However, as should be appreciated, the exhaust gas 72 retrieved for use as purge gas 68 may be tapped off (e.g., via extraction or bleed connections) at any suitable point of the exhaust system 74, and may pass through one or more portions of the exhaust system 74 or be tapped off (e.g., via a wastegate) prior to typical exhaust treatment/processing. For example, in some embodiments, the exhaust gas 72 may be tapped off prior to the turbine stage to maintain a higher pressure for flowing through one or more auxiliary treatments 76 and/or to be higher than the process gas pressure within the chamber 24. However, as should be appreciated, if the exhaust pressure after the turbine stage is lower than desired a supplemental pump may be used to increase the pressure of the exhaust gas 72 prior to the packing case 66. As should be appreciated, the tap off point for the purge gas 68 may be selected based on desired treatment/processing and/or pressure. Alternatively, the tap off point may be chosen regardless of pressure and treatment/processing, for example, when utilizing other pressure regulation elements (e.g., boost pumps, valves, etc.) and/or auxiliary treatments 76.

Figure 2:
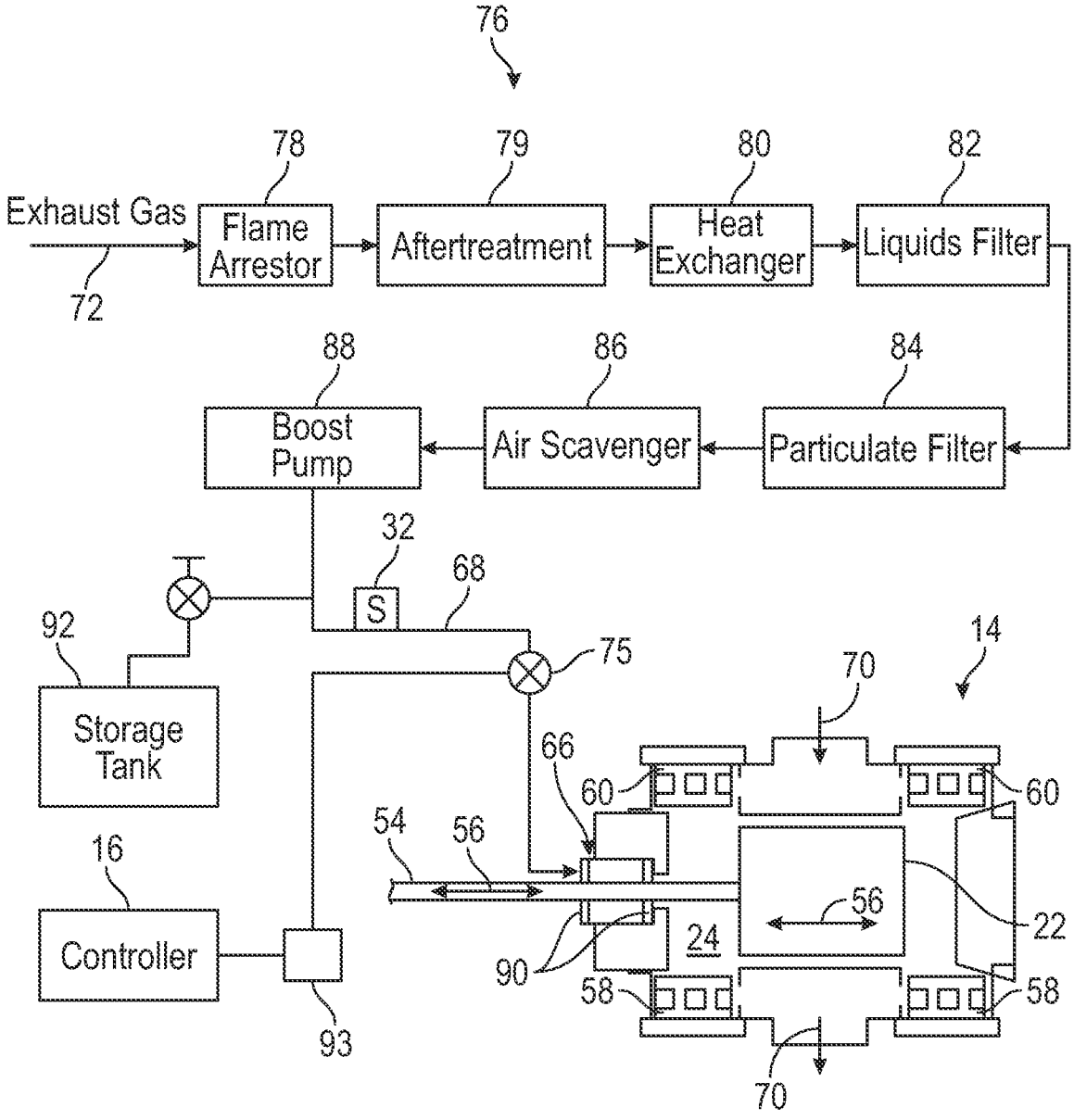
FIG. 2 is a schematic block diagram of example treatments for the exhaust gas prior to introducing the purge gas to the packing case, in accordance with an embodiment.

In conjunction with or instead of the exhaust treatments of the exhaust system 74, the exhaust gas 72 tapped off for use as purge gas 68 may be treated/processed through one or more auxiliary treatments 76 prior to the packing case 66, as in FIG. 2. In some embodiments, the exhaust gas 72 may progress through one or more flame arrestors 78 to reduce or eliminate further combustion. For example, a flame arrestor 78 may increase the lifespan of components downstream of the flame arrestor 78. Additionally, in some embodiments, an aftertreatment 79 may be performed to reduce or process trace species within the exhaust gas 72. Such trace species may include but are not limited to carbon oxides ($CO_X$) such as carbon dioxide ($CO_2$) and carbon monoxide (CO), sulfur oxides ($SO_X$) such as sulfur dioxide ($SO_2$), nitrogen oxides ($NO_X$) such as nitrogen dioxide ($NO_2$) and nitrous oxide ($N_2O$), unburned hydrocarbons (UHC), Formaldehyde ($CH_2O$), Ammonia ($NH_3$), Mercury (Hg). In some embodiments, the aftertreatment 79 may utilize one or more catalysts to reduce/remove the exhaust gas trace species. As non-limiting examples, a three-way catalyst may be utilized during stoichiometric operation, an oxidation catalyst may be utilized during lean burn operations, and optionally a Selective Catalytic Reduction (SCR) system with ammonia slip catalyst (ASC) may be utilized as part of the aftertreatment 79. Moreover, the exhaust gas 72 may be cooled via one or more heat exchangers 80, such as direct or indirect heat exchangers or intercoolers. Cooling may increase the manageability of the exhaust gas 72 and/or reduce the temperature below the dew point, such that water vapor and/or other vaporized substances condense. Additionally, a liquids filter 82 may remove the condensate such as water and/or saturated vapors. The liquids filter 82 may include a liquid gas separator, such as a centrifugal separator, a gravity separator, or a combination thereof. Further, a particulate filter 84 may be used to remove particles and/or particular substances from the exhaust gas 72. For example, in some embodiments, the particulate filter 84 may target (e.g., be sufficient to filter out) sulfated ash, phosphorus, and sulfur (SAPS), which may have been generated during the operation of the engine 12. Additionally, other particles such as dust from the air intake manifold 36, soot produced in combustion, particulates in the fuel, wear metals, etc. may also be targeted by the particulate filter 84 to reduce or prevent contamination of the purge gas 68 to be introduced to the packing case 66. Additionally, in some embodiments, the exhaust gas 72 may pass through an air scavenger 86 to further reduce the oxygen content of the exhaust gas 72. Moreover, in some embodiments, a boost compressor or pump 88 may be utilized to increase the pressure of the purge gas 68 to be higher than the process gas pressure within the chamber 24. The boost compressor or pump 88 may be any suitable compressor or pump for increasing the pressure of the purge gas 68. For example, the boost compressor or pump 88 may be an electric compressor or pump driven by an electric motor or an engine driven compressor or pump driven by an engine 12 (e.g., via a belt drive, power take-off (PTO), or direct drive). As should be appreciated, the auxiliary treatments 76 of FIG. 2 are given as examples and may or may not be utilized, depending on implementation (e.g., exhaust gas composition and/or process gas composition). Additionally, one or more of the auxiliary treatments 76 may be combined and/or reordered. For example, the liquids filter 82 and air scavenger 86 may be combined to filter out water (liquid and/or vapor) and oxygen via a combined filter (e.g., an iron powder and sodium chloride based oxygen scavenger, an activated zinc filter, etc.). Furthermore, one or more auxiliary treatments 76 may be performed as part of the exhaust system 74 and may or may not be separated out/dedicated for the portion of the exhaust gas 72 used as purge gas 68.

After treatment, if implemented, the purge gas 68 may be routed to the packing case 66 to counter the pressurized leakage of the process gas 70 from the gas compressor 14. As stated above, in some embodiments, the engine 12 that drives the gas compressor 14 may provide the exhaust gas 72 for use as the purge gas 68. However, when the gas compression system 10 is deactivated (e.g., the engine 12 is off) exhaust gas 72 production may be stopped. As such, in some embodiments, one or more static seals 90 may be implemented to seal around the compressor rod 54 such that the process gas 70 does not leak from the chamber 24 and/or packing case 66 to the environment while the compressor rod 54 is static (e.g., not moving). For example, if one or more of the discharge values 58 and/or intake valves 60 remain open while the gas compression system 10 is deactivated, the static seal(s) 90 may help reduce or eliminate continued leakage. As should be appreciated, the static seal(s) 90 may be disengaged when the compressor rod 54 is in motion (e.g., reciprocating motion 56). Furthermore, in some scenarios, purge gas 68 may be momentarily unavailable during startup of the gas compression system 10 even though the compressor rod 54 is in motion. As such, in some embodiments, a storage tank 92 may hold residual purge gas 68 to supplement momentary reductions or vacancies in purge gas production, such as during startup, shutdown, transient conditions, or other conditions with limited or no availability of the exhaust gas 72.

As discussed above, in some embodiments, a valve 75 may allow or prevent the purge gas 68 from reaching the packing case 66. For example, the controller 16 may control a solenoid 93 that actuates the valve 75. As should be appreciated, the valve 75 may be of any suitable type and have any suitable actuation circuitry/motivators. After the exhaust system 74 and/or auxiliary treatment 76 the purge gas 68 may be in a state (e.g., e.g., temperature, composition, etc.) suitable for introduction into the packing case 66. However, if the purge gas 68 is not in a suitable state (e.g., as measured by a sensor 32), the controller 16 may direct the valve 75 (e.g., via the solenoid 93) to close. For example, if the oxygen content, particulate content, or trace gas content of the purge gas 68 is above the corresponding threshold (e.g., an oxygen content threshold, a particulate content threshold, and/or trace gas content threshold) the valve 75 may be closed. Furthermore, in some embodiments, the controller 16 may operate the engine 12 by adjusting an air-to-fuel ratio based on the state of the purge gas 68 such that the purge gas 68 is within a set of limits, which may be specified depending on implementation.

Figure 3:
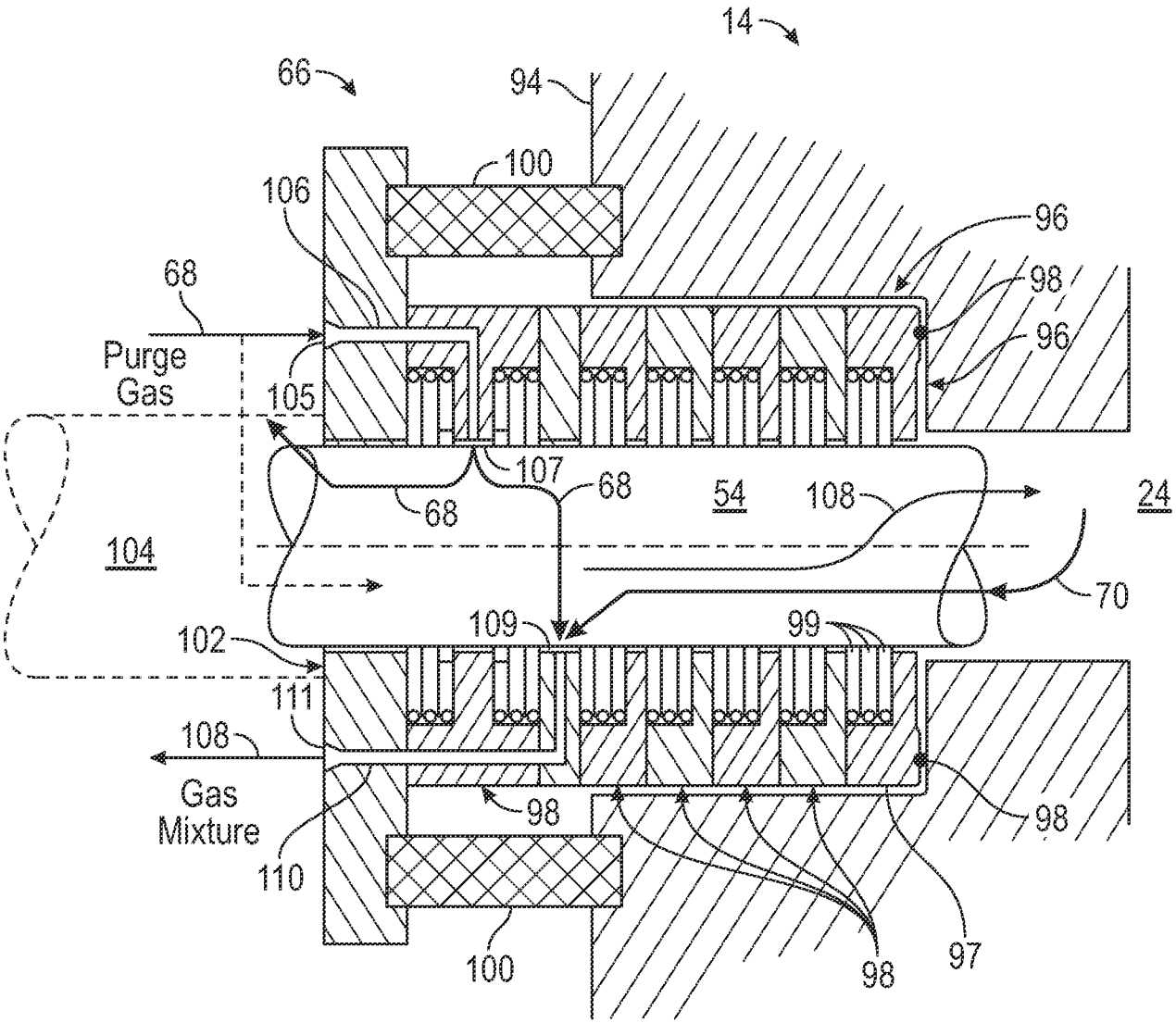
FIG. 3 is a side view of a packing case with a purge passage and a vent passage, in accordance with an embodiment.

As discussed above, the packing case 66 may couple to the housing 94 of the gas compressor 14 at an interface 96, as shown in FIG. 3. Moreover, the compressor rod 54 may provide the reciprocating motion 56 to the piston 22 by extending through an orifice of the housing 94, through the packing case 66, and to a mechanical driver (e.g., engine 12). One or more seals 98 (e.g., annular seals) may seal the packing case 66 against the housing 94 and/or compressor rod 54, and one or more securements 100 (e.g., bolts, screws, clips, fasteners, retainers, etc.) may affix the packing case 66 to the housing 94. In the illustrated embodiment, the packing case 66 includes and supports multiple seals 98, each having an annular packing or seal support 97 with one or more annular seal elements 99 (e.g., seal rings, packing cups, etc.). In some embodiments, the outer face 102 of the packing case 66 may be pressurized with the purge gas 68, such that the purge gas 68 creates a barrier around the compressor rod 54 forcing the process gas 70 back towards the chamber 24. For example, a casing 104 may surround the compressor rod 54, and the casing 104 may be pressurized with the purge gas 68. Additionally or alternatively, the packing case 66 may have a purge passage 106 to receive the purge gas 68 and distribute the purge gas 68 within the packing case 66. The purge passage 106 includes a first port or inlet 105 and a second port or outlet 107, wherein the outlet 107 is disposed along the compressor rod 54. When maintained at a higher pressure than the process gas 70 within the chamber 24, the purge gas 68 may permeate through the packing case 66 towards the chamber 24 and/or back towards the outer face 102 of the packing case 66. Additionally, the purge gas 68 and process gas 70 may form a gas mixture 108 that progresses to the chamber 24 (and to the downstream system 48) and/or to a vent passage 110. The vent passage 110 includes a first port or inlet 109 and a second port or outlet 111, wherein the inlet 109 is disposed along the compressor rod 54. As the pressure of the purge gas 68 is higher than that of the process gas 70 at the distal end (e.g., outer face 102) of the packing case 66 and/or within the chamber 24, the mean flow (e.g., average flow) of the purge gas 68, process gas 70, and/or gas mixture 108 is towards the chamber 24 from the outer face 102 of the packing case 66. In the illustrated embodiment, the outlet 107 of the purge passage 106 is axially offset upstream from the inlet 109 of the vent passage 110, such that any leakage is vented, via the vent passage 110, downstream from the introduction of the purge gas 68.

In addition to the other benefits discussed herein, an additional benefit to using the exhaust gas 72, particularly the exhaust gas 72 from stoichiometric operation of the engine 12, is that the low oxygen content may be suitable to be introduced into the process gas 70, and indeed into the chamber 24 and to the downstream system 48, without issue. However, it may be desirable to reduce the overall amount of purge gas 68 added to the downstream flow of the process gas 70. As such, at least a portion of the gas mixture 108 may be expelled via the vent passage 110 of the packing case 66. The gas mixture 108 expelled from the vent passage 110 may include less process gas 70 than would have leaked from the packing case 66 had the purge gas 68 not been utilized for a given time period. Furthermore, the vent passage 110 may provide for controlled collection of the would-be leaked process gas 70. By collecting the gas mixture 108 from the vent passage 110, the gas mixture 108 may be controllably released (e.g., into the environment via a disposal system or flare), such that the total amount of process gas 70 is lost to the environment is reduced. Additionally or alternatively, the gas mixture 108 may be returned to the engine 12 and introduced into the intake manifold 36 or other input as part of a modified exhaust gas recirculation (EGR) process. Indeed, while the gas mixture 108 includes exhaust gas 72 from the engine 12, depending on the composition of the process gas 70, the process gas 70 within the gas mixture 108 may be used, at least partially, as fuel 38 for the engine 12. As should be appreciated, the controller 16 may utilize one or more sensors 32 to ascertain or estimate the composition of the gas mixture 108 and adjust the flow of air 34 and/or fuel 38 from the fuel source 40 accordingly.

Figure 4:
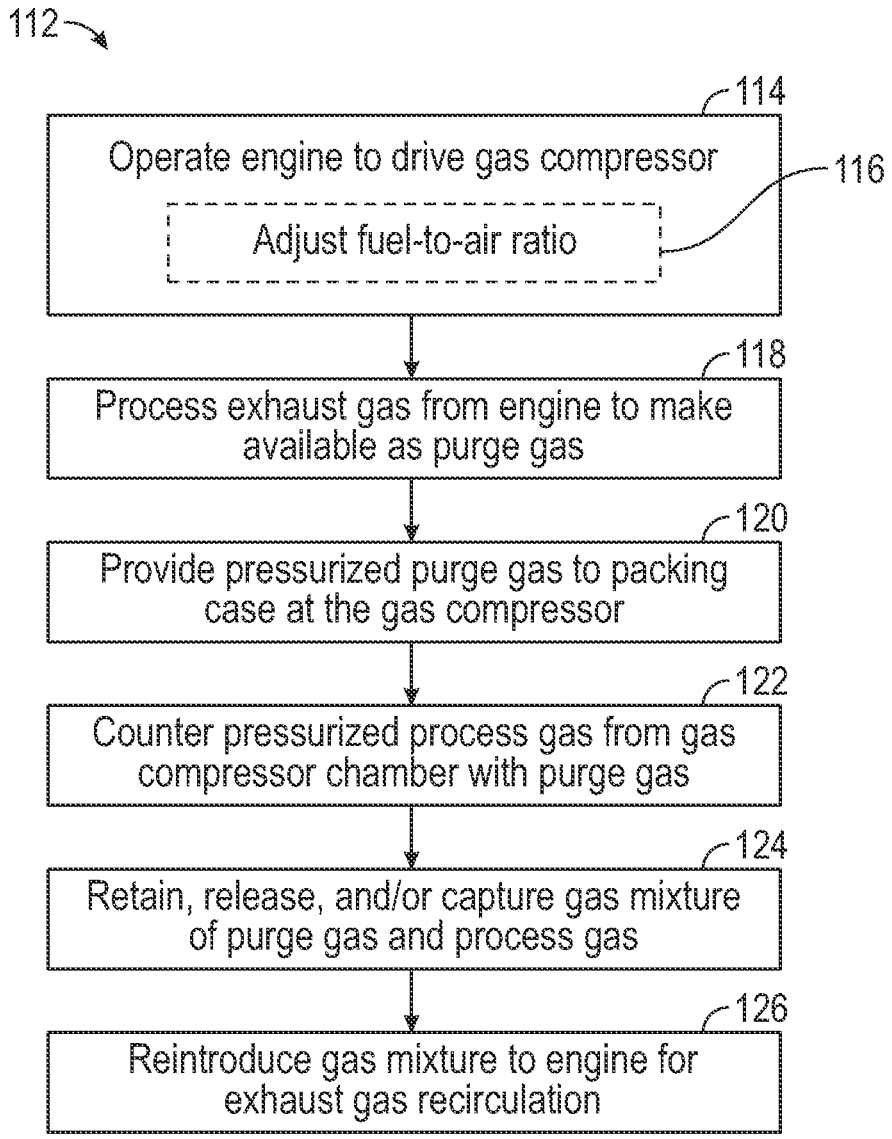
FIG. 4 is a flowchart of an example process for utilizing exhaust gas as a purge gas of a gas compression system, in accordance with an embodiment.

FIG. 4 is a flowchart 112 of an example process for utilizing exhaust gas 72 as a purge gas 68 of a gas compression system 10. The engine 12 may be operated (e.g., via the controller 16) to drive the gas compressor 14 (process block 114). In some embodiments, operating the engine 12 may include adjusting the fuel-to-air ratio (process block 116), for example, for stoichiometric operation. Exhaust gas 72 from the engine 12 may be processed (e.g., treated) to be made available as purge gas 68 (process block 118). For example, the exhaust gas 72 may be processed/treated via one or more components of the exhaust system 74 of the engine 12 and/or one or more auxiliary treatments 76, as discussed above. The processing/treatment of the exhaust gas 72 may include the operation of gas treatment systems for the removal/reduction of liquids (e.g., water), particulate (e.g., particulate matter or soot), trace exhaust chemical species (e.g., reduced via aftertreatment 79), excess oxygen, or any combination thereof, thereby generating a treated exhaust gas for use as the purge gas 68. The purge gas 68 may be provided to a packing case 66 at the gas compressor (process block 120), and the purge gas 68 may be used to counter the pressurized process gas 70 that would otherwise leak from chamber 24 of the gas compressor 14 through the packing case 66 (process block 122). Furthermore, the purge gas 68 may mix with process gas 70 to form a gas mixture 108 that may be retained within the gas compressor 14 (and progressed to the downstream system 48 via operation of the gas compressor 14), released to the environment, and/or captured for additional use (process block 124). In some embodiments, the captured gas mixture 108 may be reintroduced to the engine 12 as part of an EGR process (process block 126).

As should be appreciated, the engine 12 and gas compressor 14 discussed herein are given as non-limiting examples, and any suitable engine 12 and gas compressor 14 utilizing a purge gas 68 to reduce or eliminate process gas leakage at an interface of the compressor rod 54 may be used. Moreover, while discussed herein as a packing case 66, any suitable interface between the compressor rod 54 and the housing of the gas compressor 14 that utilizes a purge gas 68 to reduce or eliminate process gas leakage may utilize the techniques described herein. Additionally, although the flowchart 112 is shown with particular process blocks in a given order, in certain embodiments, process/decision blocks may be reordered, altered, deleted, and/or occur simultaneously. Additionally, the flowchart 112 is given as an illustrative tool and further decision and process blocks may also be added depending on implementation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A gas compression system comprising:

a gas compressor comprising a compressor rod, a piston mechanically coupled to the compressor rod, and an interior chamber, wherein the gas compressor is configured to:

receive a process gas at a first pressure;

pressurize the process gas in the interior chamber by compressing the process gas via the piston in response to actuation of the compressor rod; and output the process gas at a second pressure higher than the first pressure;

an internal combustion engine mechanically coupled to the gas compressor and configured to actuate the compressor rod of the gas compressor and to generate an exhaust gas during the actuation of the compressor rod; and a packing case disposed around the compressor rod and mechanically coupled to the gas compressor, wherein a first side of the packing case is fluidly coupled to the interior chamber, and wherein the packing case is configured to receive the exhaust gas and to direct the exhaust gas to counter a flow of the process gas through the packing case from the interior chamber.

2. The gas compression system of claim 1, wherein the packing case is configured to receive the exhaust gas at a second side of the packing case, wherein an average flow of the process gas and the exhaust gas within the packing case is directed away from the second side of the packing case.

3. The gas compression system of claim 2, wherein the second side of the packing case comprises an outer face of the packing case opposite the first side, wherein the second side of the packing case further comprises a purge passage configured to receive the exhaust gas and direct the exhaust gas to an interior of the packing case, wherein the compressor rod is configured to actuate through the interior of the packing case.

4. The gas compression system of claim 1, wherein the internal combustion engine is configured to operate on a stoichiometric balance of fuel and oxygen having a lambda (λ) between 0.990 and 1.100.

5. The gas compression system of claim 1, wherein the internal combustion engine is configured to operate in a lean burn combination of fuel and oxygen having a lambda (λ) greater than or equal to 1.100.

6. The gas compression system of claim 1, wherein the exhaust gas passes through one or more auxiliary treatment systems prior to being received by the packing case.

7. The gas compression system of claim 6, wherein the one or more auxiliary treatment systems comprise a flame arrestor, a heat exchanger, a liquids filter, a particulate filter, an air scavenger, or any combination thereof.

8. The gas compression system of claim 6, wherein the one or more auxiliary treatment systems comprise a boost pump.

9. The gas compression system of claim 8, wherein the boost pump is driven via a mechanical coupling to the internal combustion engine.

10. The gas compression system of claim 1, wherein the internal combustion engine comprises a turbo charger and an exhaust system, wherein the exhaust system comprises a turbine section of the turbo charger, wherein the exhaust gas is diverted from the exhaust system prior to the turbine section.

11. The gas compression system of claim 1, wherein the packing case comprises a vent passage configured to expel a gas mixture from the packing case, wherein the gas mixture comprises at least a portion of the exhaust gas and at least a portion of the process gas.

12. The gas compression system of claim 11, wherein the gas mixture is expelled from the packing case and directed, via the vent passage, to an intake of the internal combustion engine as part of an exhaust gas recirculation system.

13. The gas compression system of claim 1, comprising a static seal coupled to the packing case, the gas compressor, or both, wherein the static seal is configured to reduce the flow of the process gas while the compressor rod is not actuating.

14. The gas compression system of claim 1, comprising a controller configured to regulate, via a valve, the exhaust gas to the packing case based on an oxygen content of the exhaust gas.

15. A method comprising:

actuating a compressor rod of a gas compressor such that a process gas is pressurized within a chamber of the gas compressor, wherein the compressor rod extends from the chamber and through a packing case coupled to the gas compressor;

generating, via combustion, exhaust gas; and supplying the exhaust gas to the packing case such that the exhaust gas permeates:

through the packing case;

around the compressor rod; and into the chamber, out a vent passage of the packing case, or both.

16. The method of claim 15, wherein the compressor rod is actuated by an electric motor.

17. The method of claim 15, comprising:

measuring, via a sensor disposed upstream of the packing case along a supply line of the exhaust gas, an oxygen content of the exhaust gas; and in response to determining that the oxygen content is greater than a threshold, closing a valve of the supply line upstream of the packing case.

18. The method of claim 15, comprising supplying the exhaust gas and the process gas that permeate out the vent passage of the packing case to an intake of an internal combustion engine, wherein the internal combustion engine is configured to generate the exhaust gas via the combustion.

19. The method of claim 18, comprising supplying the exhaust gas to a second packing case of a second gas compressor such that the exhaust gas permeates:

through the second packing case;

around a second compressor rod of the second gas compressor; and into a second chamber of the second gas compressor, out a second vent passage of the second packing case, or both.

20. A gas compressor comprising:

a housing having an interior chamber, an intake to the interior chamber, an outlet from the interior chamber, and a compressor rod orifice;

a piston configured to actuate within the interior chamber and operatively motivate a first flow of a process gas from the intake to the outlet;

a compressor rod mechanically coupled to the piston within the interior chamber and extending out of the interior chamber through the compressor rod orifice, wherein actuation of the compressor rod actuates the piston; and a packing case coupled to and sealed against the housing, wherein the compressor rod extends through an interior of the packing case, wherein the packing case is configured to receive and direct a purge gas into the interior of the packing case at a first pressure higher than a second pressure within the interior chamber of the housing to reduce a second flow of the process gas from the interior chamber through the interior of the packing case, wherein the purge gas is an exhaust gas from a hydrocarbon combustion process.

* * * * *